US011703222B2

(12) United States Patent
Penner et al.

(10) Patent No.: US 11,703,222 B2
(45) Date of Patent: Jul. 18, 2023

(54) FIREBOX FLOOR OF A FURNACE FOR COMBUSTING WOOD

(71) Applicant: HEATMASTER FURNACES INC., Winkler (CA)

(72) Inventors: Albert Penner, Winkler (CA); Blair Allan Groening, Winkler (CA); Bernhard Wall, Winkler (CA); Jake Isaac Friesen, Winkler (CA)

(73) Assignee: Heatmaster Furnaces Inc., Winkler (CA)

( * ) Notice: Subject to any disclaimer, the term of this patent is extended or adjusted under 35 U.S.C. 154(b) by 268 days.

(21) Appl. No.: 17/308,384

(22) Filed: May 5, 2021

(65) Prior Publication Data

US 2021/0396385 A1 Dec. 23, 2021

Related U.S. Application Data

(60) Provisional application No. 63/042,641, filed on Jun. 23, 2020.

(51) Int. Cl.

| | |
|---|---|
| ***F23M 5/00*** | (2006.01) |
| ***F24B 1/02*** | (2006.01) |
| ***F24B 13/00*** | (2006.01) |
| ***F24B 7/00*** | (2006.01) |
| ***F24B 7/04*** | (2006.01) |
| ***F24B 13/02*** | (2006.01) |
| ***F23B 10/02*** | (2011.01) |
| ***F23B 60/00*** | (2006.01) |

(52) U.S. Cl.

CPC ..... *F23M 5/00* (2013.01); *F23B 10/02* (2013.01); *F23B 60/00* (2013.01); *F24B 1/026* (2013.01); *F24B 7/005* (2013.01); *F24B 7/045* (2013.01); *F24B 13/006* (2013.01); *F24B 13/02* (2013.01); *F23M 2700/005* (2013.01)

(58) Field of Classification Search

CPC ..... F23B 10/02; F24B 1/026

See application file for complete search history.

(56) References Cited

U.S. PATENT DOCUMENTS 2,965,052 A * 12/1960 Wernheim ..... F24B 13/00 110/322
4,194,487 A * 3/1980 Cadwallader ..... F24B 5/04 126/76
4,438,756 A * 3/1984 Chamberlain ..... F23G 7/07 126/525

(Continued)

*Primary Examiner* — David J Laux

(74) *Attorney, Agent, or Firm* — Christopher J. Dynowski; Ryan W. Dupuis; Ade & Company Inc.

(57) ABSTRACT

A furnace for combusting wood comprises a firebox floor in a primary burn chamber of the furnace, where the wood is received for generating a gas therefrom, that is defined by a thermally conductive body of refractory material. The body of refractory material defines an upper support surface arranged to support the wood above or over the same. The body of refractory material also defines, beneath the upper support surface, a duct as part of a secondary burn chamber of the furnace which is arranged (i) to be communicated with the primary burn chamber of the furnace to receive the gas generated by heating of the wood therein and carrying combustible products, and (ii) to convey the gas in a manner supporting combustion of the combustible products carried thereby.

28 Claims, 7 Drawing Sheets

(56) References Cited

U.S. PATENT DOCUMENTS

| | | | | | |
|---|---|---|---|---|---|
| 4,545,360 | A * | 10/1985 | Smith | F24B 5/026 | 126/61 |
| 5,014,680 | A * | 5/1991 | Siemer | F23L 9/00 | 126/289 |
| 5,701,882 | A * | 12/1997 | Champion | F24B 1/191 | 126/528 |
| 2008/0083404 | A1 * | 4/2008 | Rappold | F24H 3/087 | 126/524 |
| 2008/0223355 | A1 * | 9/2008 | Spencer | F24B 13/02 | 126/77 |
| 2019/0368741 | A1 * | 12/2019 | Alvarado | F24B 5/021 | |

* cited by examiner

FIREBOX FLOOR OF A FURNACE FOR COMBUSTING WOOD

This application claims the benefit under 35 U.S.C. 119(e) of U.S. Provisional application Ser. No 63/042,641 filed Jun. 23, 2020.

FIELD OF THE INVENTION

The present invention relates generally to a firebox floor for a furnace in which wood is combusted to generate heat, and more particularly to such a firebox floor which forms a secondary burn chamber of the furnace.

BACKGROUND

It is generally known to provide in a furnace for combusting a solid biomass fuel a primary burn chamber for containing the fuel to be combusted and a secondary burn chamber in which combustion of products, which are carried by gas generated in the primary burn chamber, is arranged to take place, before the gas is released to a heat exchanger arranged for transferring heat from the gas to a heating medium, such as water in the case of a boiler furnace. This provides substantially complete combustion of the fuel such that emission products released to an ambient environment are generally limited to carbon dioxide and water.

Wood is one example of solid biomass fuel for which it is difficult to provide complete combustion.

SUMMARY OF THE INVENTION

According to an aspect of the invention there is provided a furnace for combusting wood comprising:

a base arranged for resting on a support surface;

a housing supported on the base and defining a primary burn chamber arranged for containing the wood to generate a combustible gas therefrom;

a body of refractory material carried at a bottom of the primary burn chamber and defining an upper support surface arranged for supporting the wood thereon that defines a floor of the primary burn chamber;

a secondary burn chamber in communication with the primary burn chamber for receiving the combustible gas generated in the primary burn chamber and arranged for combusting the combustible gas to generate exhaust gas which is substantially free of incompletely combusted products of combustion;

a heat exchanger supported in the housing outside the primary and secondary burn chambers and in communication with the secondary burn chamber to receive the exhaust gas therefrom, the heat exchanger being configured for transferring heat from the exhaust gas to a heating medium which acts to subsequently distribute the heat;

a flue in communication with the heat exchanger and arranged for releasing the exhaust gas with the heat removed therefrom to an ambient environment of the furnace; and a fan operatively carried by the housing at a downstream location from the secondary burn chamber and arranged to generate an airflow to draw gas from the primary burn chamber and to the flue so as to define a flow of gas through the furnace;

wherein the body of refractory material is thermally conductive; and wherein the secondary burn chamber comprises a combustion duct which is defined in the body of thermally conductive refractory material below the upper support surface and arranged to convey the combustible gas and to support combustion thereof upon conveyance through the combustion duct before release to the heat exchanger.

This provides an arrangement for generating heat from wood which produces substantially no incompletely combusted emission products for discharge to the atmosphere.

Preferably the secondary burn chamber comprises:

an intake duct intercommunicating the primary burn chamber and the combustion duct downstream therefrom relative to the flow of the gas through the furnace; and a plurality of nozzles in fluidic communication with the intake duct and arranged for injecting fresh air into the secondary burn chamber for mixing with the combustible gas for subsequent combustion in the combustion duct.

Preferably the nozzles are arranged at spaced positions around a peripheral wall of the intake duct such that the fresh air is introduced into the intake duct substantially around a full periphery of the intake duct.

In the illustrated arrangement, each nozzle is located at a diametrically offset position from a generally opposite one of the nozzles. Thus flows of the fresh air from the nozzles may promote better mixing with the combustible gas.

Preferably the intake duct defines an inlet of the secondary burn chamber in the floor such that the intake duct extends through the floor to the combustion duct in the body of the refractory material.

In the illustrated arrangement, the intake duct is defined by a metallic grate member supported by the body of refractory material above the combustion duct and defining an upper surface collectively forming with the body of refractory material the floor of the primary burn chamber.

Preferably, when the secondary burn chamber comprises an intake duct intercommunicating the primary burn chamber and the combustion duct downstream therefrom relative to the flow of the gas through the furnace, the combustion duct is arranged to convey the combustible gas in a transverse direction to a direction of conveyance of the intake duct, and an opening intercommunicating the intake duct and the combustion duct is arranged at a transversely centrally offset location relative to the combustion duct such that transfer of the combustible gas from the intake duct to the combustion duct acts to generate turbulence in the flow of the combustible gas through the combustion duct.

Preferably the combustion duct comprises a rounded peripheral wall arranged to convey the combustible gas and the intake duct extends tangentially to the combustion duct.

Preferably the combustion duct comprises an upstream linear portion extending linearly from the intake duct and a turn downstream from the intake duct which extends from the upstream linear portion in a transversely opposite direction relative to a side of the upstream linear portion on which the intake duct is located.

Preferably the combustion duct further comprises a downstream linear portion extending from the turn in an opposite longitudinal direction to the upstream linear portion such that a direction of the flow of the combustible gas along the downstream linear portion is substantially reversed relative to a direction of the flow of the combustible gas along the upstream linear portion.

In one arrangement, the downstream linear portion extends from the turn in generally parallel relation to the upstream linear portion. In other words the upstream linear portion, the turn and the downstream linear portion are collectively generally in the shape of a U.

Preferably the combustion duct comprises at least one turn of at least about 90 degrees arranged to generate turbulence in the flow of the gas through the combustion duct.

In one arrangement, the at least one turn comprises a first turn between about 150 degrees and about 190 degrees.

In the illustrated arrangement, the first turn is about 180 degrees.

In the illustrated arrangement, the first turn is the only turn of the combustion duct.

In one arrangement, the secondary burn chamber comprises a plurality of turns arranged to generate turbulence in the flow of gas therealong, and a sum of angles of all of the turns is from about 270 degrees to about 360 degrees.

Preferably the secondary burn chamber further comprises:

an ash deposition duct in downstream communication with the combustion duct and arranged to receive therefrom the exhaust gas substantially free of the incompletely combusted products of combustion;

wherein the ash deposition duct is formed within the housing but externally of the body of refractory material; and wherein the ash deposition duct has a larger cross-section than the combustion duct so that the flow of the exhaust gas has reduced velocity conducive to permitting ash carried by the exhaust gas to gravitationally separate therefrom.

Preferably the ash deposition duct comprises at least one turn of at least about 90 degrees arranged to separate the ash from the flow of exhaust gas by inertia.

In one arrangement, the ash deposition duct comprises a peripheral wall arranged to convey the exhaust gas that is collectively formed by the body of refractory material and the housing.

In the illustrated arrangement, the combustion duct and the ash deposition duct meet to form a turn of at least about 90 degrees.

In the illustrated arrangement, an outer side of the turn between the combustion duct and the ash deposition duct is defined by a wall of thermally conductive refractory material connected to the body of refractory material so as to receive heat therefrom.

In the illustrated arrangement, the ash deposition duct comprises a plurality of turns at spaced positions relative to the flow of the exhaust gas through the ash deposition duct, each of the turns being of at least about 90 degrees.

In the illustrated arrangement, the ash deposition duct formed externally of the body of refractory material is longer in length than the combustion duct formed internally of the body of refractory material.

Preferably, the ash deposition duct has an upstream portion which is in communication with the combustion duct to receive the exhaust gas therefrom and a downstream portion in communication with the heat exchanger to release the exhaust gas thereto, and the downstream portion of the ash deposition duct has larger cross-section than the upstream portion thereof.

Preferably the upstream and downstream portions of the ash deposition duct meet at a turn of at least about 90 degrees.

Preferably the secondary burn chamber comprises an inlet defined in the floor and in communication with the primary burn chamber to enable passage of the combustible gas therefrom and to the combustion duct.

Preferably the inlet is substantially centrally located on the floor.

In One Arrangement:

the housing comprises a common generally vertically-oriented partition wall spanning from a bottom of the housing to a top thereof and separating the primary and secondary burn chambers from the heat exchanger;

the secondary burn chamber comprises an outlet arranged in communication with the heat exchanger through the partition wall;

the outlet is located at a horizontally centrally offset location;

the secondary burn chamber defines a path for the flow of gas from the inlet to the outlet; and the path of the secondary burn chamber comprises:

an initial portion defining the inlet and the combustion duct and extending from a central location beneath the floor towards a location on the partition wall which is horizontally to the side of the outlet, and a downstream turn extending from the initial portion in a direction away from the outlet.

Preferably, the secondary burn chamber comprises an outlet arranged in communication with the heat exchanger and defined below the floor such that substantially a whole of the secondary burn chamber is below the primary burn chamber.

According to another aspect of the invention there is provided a firebox floor for supporting wood in a firebox of a furnace for combustion in the furnace, the firebox floor comprising:

a body of refractory material defining an upper support surface arranged for supporting the wood thereover;

wherein the refractory material is thermally conductive; and a duct defined in the body of thermally conductive refractory material and arranged:

to be communicated with the firebox of the furnace to receive gas generated by heating of the wood therein and carrying combustible products, and to convey the gas in a manner supporting combustion of the combustible products carried thereby.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 2:
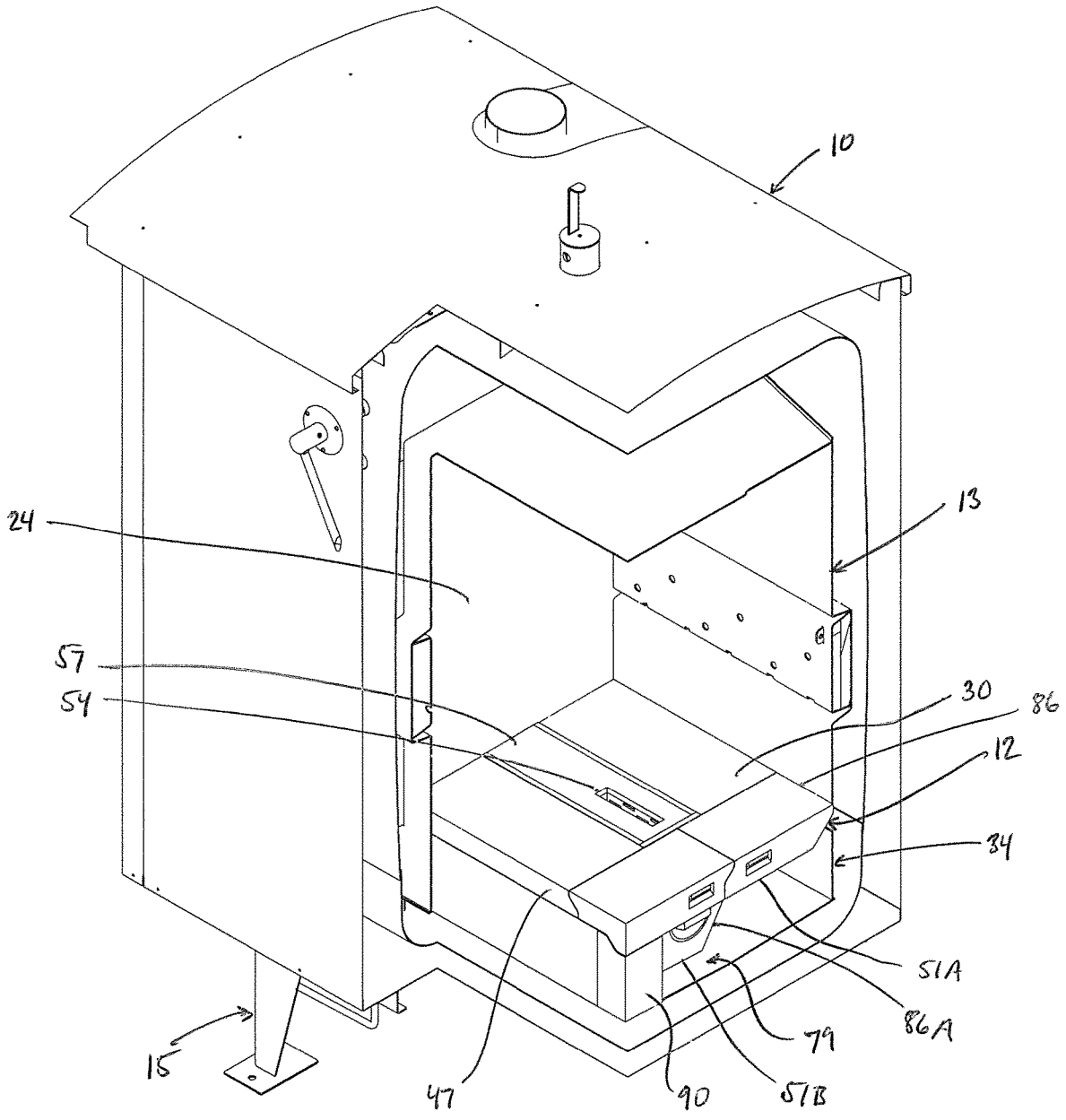
FIG. 2 is a perspective view similar to FIG. 1 but with a portion of the furnace cutaway to show burn chambers thereof.

In the accompanying figures there is shown a furnace 10 with a firebox floor 12, as more clearly shown in FIG. 5-8, for supporting wood in a firebox 13 of the furnace 10 (as shown in, for example, FIG. 2) for combustion of the wood in the furnace.

Referring to FIGS. 1-4, the furnace 10 comprises a base 15 arranged for resting on a support surface in the form of a plurality of legs having bottoms or feet arranged for engaging the support surface, and a housing 16 which is supported on the base 15 for containing or supporting components of the furnace. The housing 16 comprises a plurality of exterior walls including a front exterior wall 18, a longitudinally opposite rear wall 19, transversely opposite side walls 20, a bottom wall 21 defining a base of the housing 16 to which the legs 15 are connected, and a top wall 22, which are collectively arranged to form an enclosed container for containing or supporting other components of the furnace. The housing walls such as 18-22 are generally thermally-insulated to help retain heat in the furnace, for example by being formed of plural layers of metal separated by air gaps.

Figure 1:
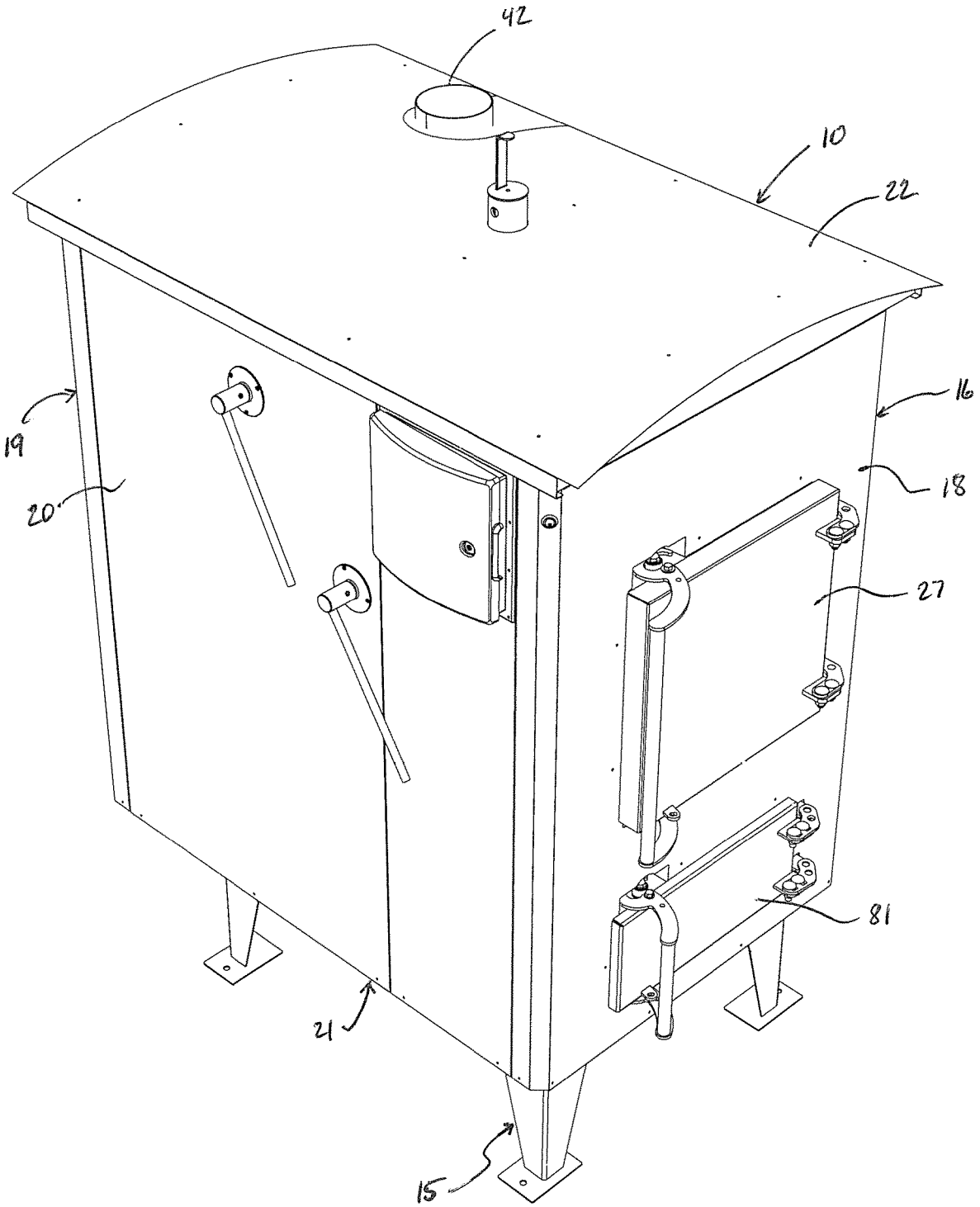
FIG. 1 is a perspective view of an arrangement of furnace according to the present invention.
Figure 3:
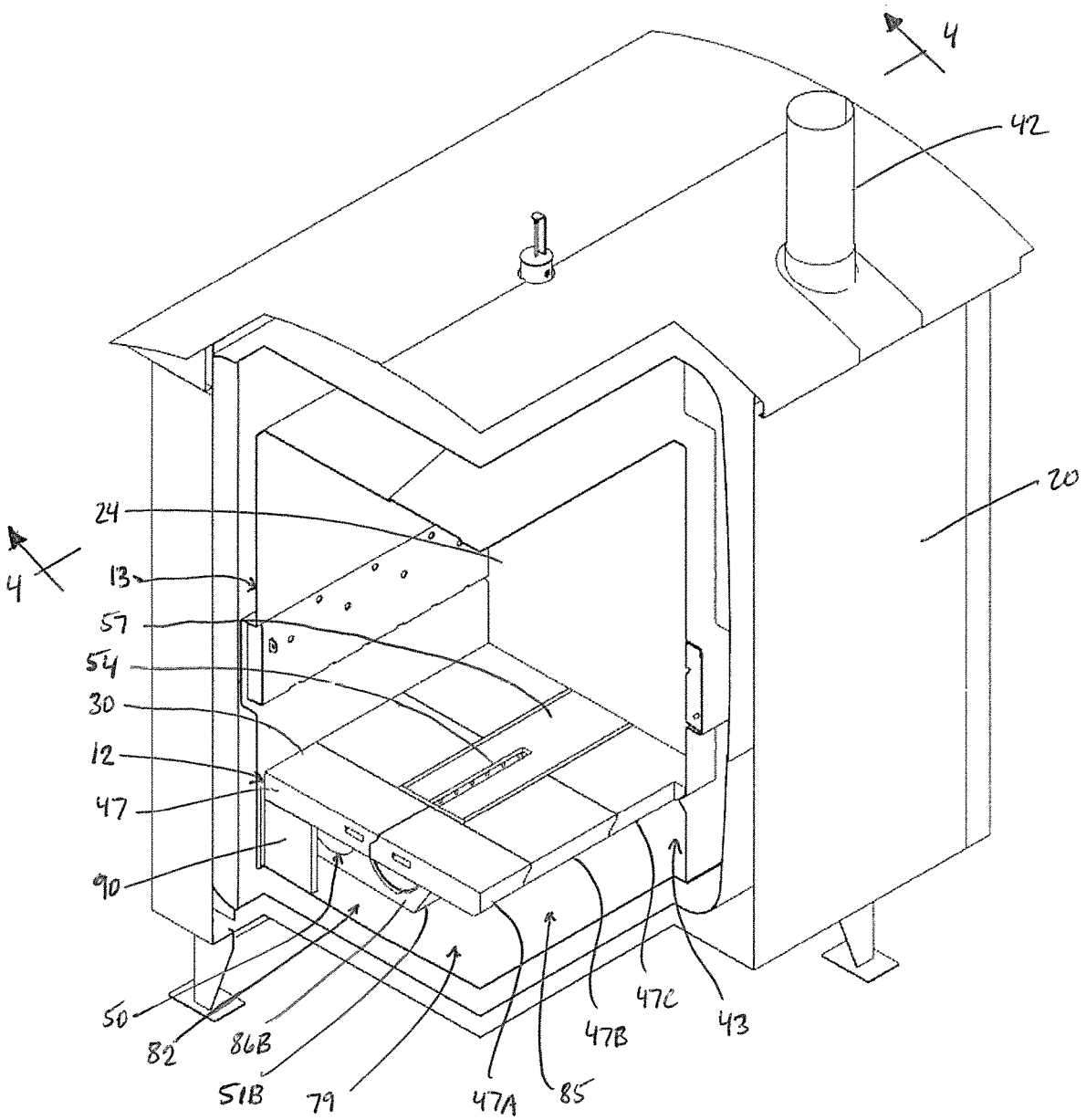
FIG. 3 is another cutaway perspective view of the furnace of FIG. 1 showing the burn chambers.
Figure 4:
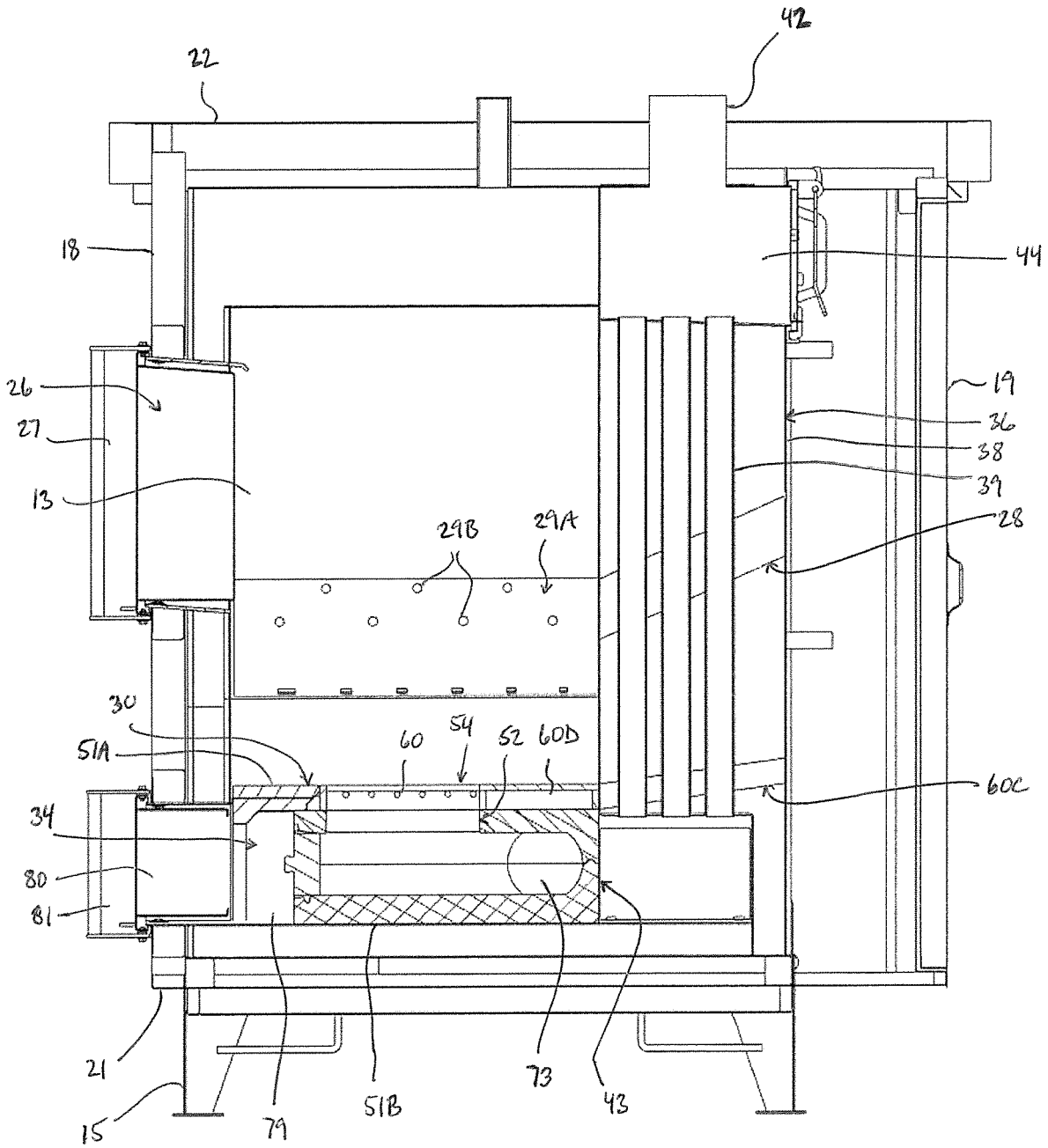
FIG. 4 is a cross-sectional view along line 4-4 in FIG. 3.

The housing 16 defines a primary burn chamber or firebox 13 arranged for containing the wood to generate a hot combustible gas therefrom. In the illustrated arrangement, this is provided by a generally vertically-oriented interior partition wall 24 of the housing disposed at a longitudinally intermediate location between the front and rear walls 18, 19, which spans from the bottom of the housing defined at 21 to the top thereof defined at 22 and from one side of the housing as shown in FIG. 1 at 20 to the other as shown in FIG. 3 at 20. The partition wall 24 thus substantially separates or compartmentalizes an interior of the housing 16 into distinct chambers, one of which is arranged at the front of the housing and the other at the rear. In the illustrated arrangement, the primary burn chamber 13 is carried in the interior of the housing in front of the partition wall 24 so as to be accessible from the front of the housing 16 which is typically left unobstructed, so that the furnace can be stoked or, in other words, the solid fuel to be combusted in the furnace can be inserted into same. The primary burn chamber 13 is substantially fluidically sealed so as to contain fire therein and for containing gas generated therein to be subsequently guided through other components of the furnace. However, as more clearly shown in FIG. 4, there is provided in the front wall 18 of the housing 16 an opening 26 in communication with the primary burn chamber 13 and arranged for passing the wood fuel therethrough for placing in the primary burn chamber, which opening 26 is closed by access door 27.

Furthermore, the primary burn chamber 13 includes a duct 28 extending from through the housing 16 in communication with the ambient environment thereof and to a manifold 29A in communication with the primary burn chamber 13 via a plurality of openings 29B located in upstanding walls of the chamber 13. This enables fresh air to be introduced into the primary burn chamber to support combustion of the fuel.

The firebox floor 12 is carried at a bottom of the primary burn chamber 13 so as to leave a space thereabove in the chamber 13 for receiving the fuel in the form of wood. The firebox floor 12 defines an upper support surface 30 arranged for supporting the wood thereabove or thereover. In the illustrated arrangement, the upper support surface 30 is planar and substantially horizontally oriented. The firebox floor 12 will be described in further detail shortly.

It will be appreciated that, in the illustrated arrangement, the combustible gas generated in the primary burn chamber 13 is wood gas generated by gasification of the wood which is achieved by providing in the primary burn chamber 13 a bed of coal (not shown) on the firebox floor 12, which is set on fire or ignited to generate heat that is applied to the wood supported on or above the coal bed so as to gasify the same.

In order to combust the products carried by the gas generated in the primary burn chamber 13, the furnace 10 further includes a secondary burn chamber 34 which is in communication with the primary burn chamber 13 for receiving the gas generated therein. The secondary burn chamber 34 is arranged for combusting the wood gas to generate exhaust gas which is hot and is substantially free of incompletely combusted products of combustion, which will be better appreciated shortly. The secondary burn chamber 34 is distinct from the primary burn chamber 13 so as to receive substantially only the gas therefrom and substantially no solid fuel from the primary chamber 13. It will be appreciated that when using coal to gasify the wood in the primary burn chamber, small amounts of charcoal may be pulled into the secondary burn chamber which subsequently burns up therein. However the wood, which is the fuel from which the hot exhaust gas is derived, is not received in the secondary burn chamber 34.

The substantially completely combusted and hot gas produced in the secondary burn chamber 34 is then provided to a heat exchanger 36 of the furnace. The heat exchanger 36 is supported in the housing 16 outside the primary and secondary burn chambers 13, 34 and in communication with the secondary burn chamber 34 to receive the hot exhaust gas therefrom. As such the heat exchanger 36 is contained in the housing 16 to the rear of the interior partition wall 24 and itself forms a substantially distinct chamber from the primary and secondary burn chambers 13, 34. The heat exchanger 36 is configured for transferring heat from the hot exhaust gas to a heating medium which acts to subsequently distribute the heat to locations remote from the furnace 10. The heat exchanger 36 is of a conventional construction and comprises a container 38 arranged to contain the heating transport medium and defining the substantially distinct chamber of the heat exchanger. When the heating medium is water the container 38 may be referred to in industry as a water jacket. The container 38 defines a plurality of tubular conduits 39 arranged to convey the hot exhaust gas therethrough such that heat from the gas carried by the conduits 39 is transferred through walls thereof to the heating medium inside the container 38 for subsequent remote distribution of heat.

Furthermore, the furnace 10 includes a flue 42 in communication with the heat exchanger 36 and arranged for releasing the exhaust gas with the heat removed therefrom to an ambient environment of the furnace. Thus the flue 42 is communicated with the heat exchanger chamber 38 at a spaced and elevated location from an opening 43 communicating the secondary burn chamber 34 and the heat exchanger 36, such that hot gas which tends to rise flows with relative ease to the higher flue 42.

The furnace 10 also includes a fan 44 operatively carried by the housing 16 at a downstream location from the secondary burn chamber 34, that is downstream relative to a general flow of gas through the furnace which is from the primary burn chamber 13 to the flue 42, and arranged to generate an airflow to draw gas from the primary burn chamber 13 and to the flue 42 so as to define a flow of gas through the furnace. In the illustrated arrangement, the fan 44 is carried intermediate the flue 42 and the heat exchanger 36 such that in respect of the two burn chambers and the heat exchanger the fan 44 acts to generate suction to pull the air through these closed compartments and to the flue 42, which is downstream of the fan 44, for discharge to the environment external to the furnace.

Returning back now to the firebox floor 12 which is the particularly unique component of the furnace 10, the firebox floor 12 comprises a body of refractory material 47 which defines a majority of the upper support surface 30 of the floor 12 above which the solid fuel in the form of wood is contained. Furthermore, this refractory material 47 is thermally conductive such that heat from within the primary burn chamber 13 to which the refractory body is exposed is transmitted through the refractory material so as to heat the same and consequently elevate the temperature of this body 47. It will be appreciated that, in the illustrated arrangement, the body of refractory material 47 forming the firebox floor 12 is formed of a plurality of separate bodies, such as those indicated at 47A through 47C, which are interconnected in intimate relation to support heat transmission from one body to an adjacent one. Thus each separate body such as 47A through 47C is enabled to expand or contract relative to the other without the whole of the firebox floor 12 cracking due to such thermally-related movement.

Figure 5:
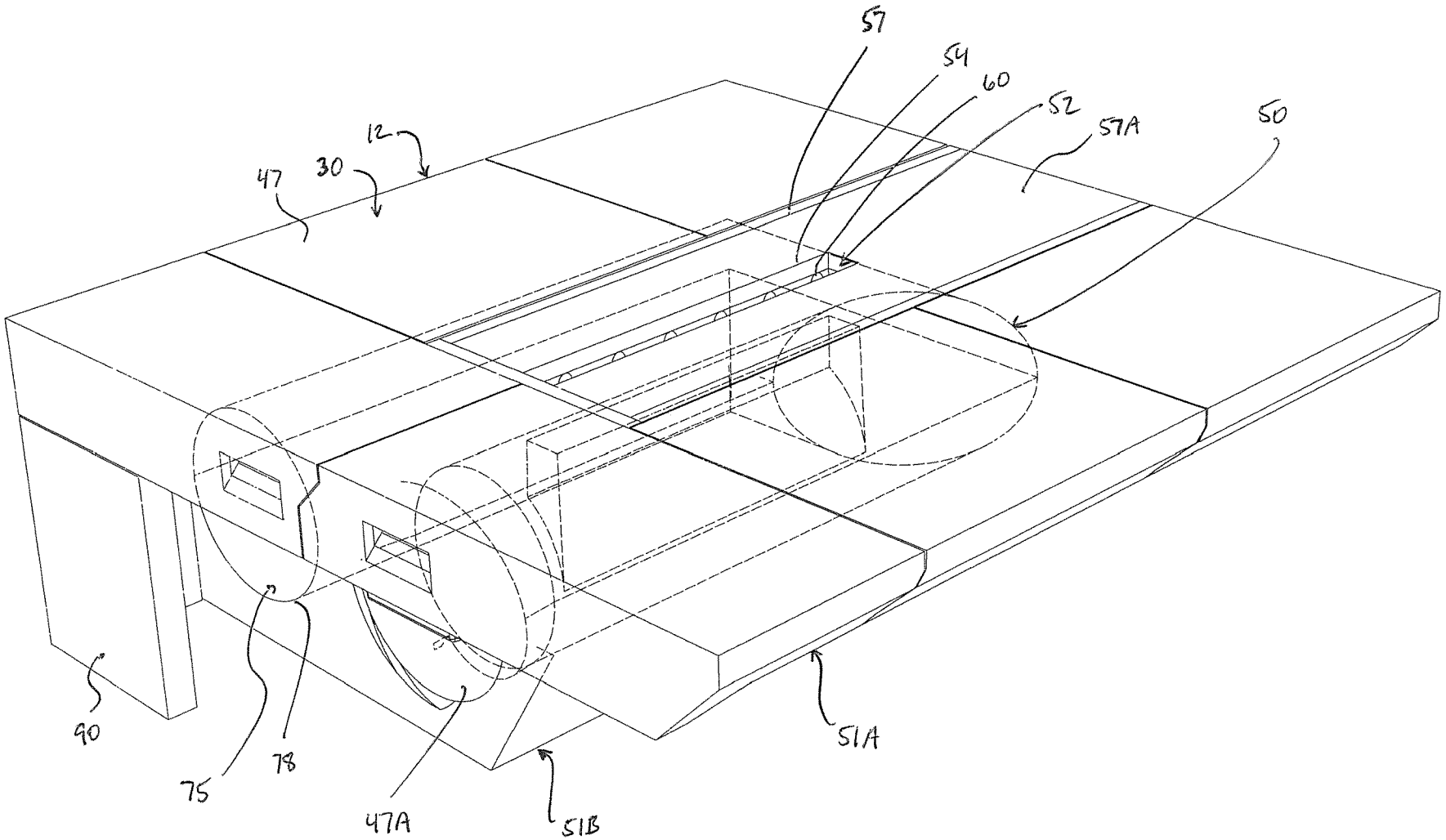
FIG. 5 is a perspective view of a firebox floor of the furnace of FIG. 1.

Yet further, and with reference to FIG. 5, the firebox floor 12 includes a duct 50 (shown in broken line in FIG. 5 but also in FIG. 7) defined in the body of thermally conductive refractory material 47 and arranged (i) to be communicated with the firebox 13 of the furnace to receive the gas which is generated by heating of the wood therein and which carries combustible products, and (ii) to convey the gas in a manner supporting combustion of the combustible products carried thereby.

In other words, the secondary burn chamber 34 comprises a combustion duct 50 which is defined in the body of thermally conductive refractory material 47 below the upper support surface 30 and arranged to convey the gas and to support combustion thereof upon conveyance through the combustion duct before release to the heat exchanger 36.

Thus the body of thermally conductive refractory material 47 comprises a floor portion 51A defining the majority of the upper support surface 30 of the floor 12 and a burn chamber portion 51B defining the combustion duct 50 below the floor surface 30, which will be described in further detail later. The floor portion 51A is arranged to span the interior of the primary burn chamber 13 from front to rear and one side to the other in order to separate the primary burn chamber 13 from at least a portion of the secondary burn chamber 34, that is at least the combustion duct 50 thereof.

Further to the combustion duct 50 defined in the body of thermally conductive refractory material 47, the secondary burn chamber 34 includes an intake duct 52 intercommunicating the primary burn chamber 13 defined over the floor 12 and the combustion duct 50 which is downstream from the primary chamber 13 relative to the flow of the gas through the furnace 10. In the illustrated arrangement, the intake duct 52 defines an inlet 54 of the secondary burn chamber 34 in the firebox floor 12 such that the intake duct 52 extends through the floor to the combustion duct 50 in the body of the refractory material. Also in the illustrated arrangement the intake duct 52 is defined by a metallic grate member 57 defining a singular slot and supported by the body of refractory material 47 above the combustion duct 50 and defining an upper surface 57A collectively forming with the body of refractory material the floor of the primary burn chamber as primarily defined by the fuel support surface 30. The grate member 57, which in the illustrated arrangement is made from stainless steel, thus defines a passageway which is the intake duct 52. In other arrangements the grate member 57 may be a steel casting.

Furthermore, the metallic grate member 57 includes a plurality of venturi-style nozzles 60 (schematically shown) in fluidic communication with the passageway formed in the member 57 so as to be fluidically communicated with the intake duct 52 of the secondary burn chamber. The nozzles 60 are arranged for injecting fresh combustion air into the secondary burn chamber 34 for mixing with the gas for subsequent combustion in the combustion duct 50. This secondary air is fresh in that it is air from outside the primary or secondary burn chambers which is clean as it has not been involved in gas generation in the primary chamber 13 or in combustion.

The secondary air nozzles 60 are arranged at spaced positions around a peripheral wall 61 of the intake duct 52, as defined by the passageway through the grate member 57, such that the fresh air is introduced into the intake duct substantially around a full periphery thereof. As the intake duct 52 is cylindrical rectangular in shape in the illustrated arrangement the nozzles 60 are arranged in two opposing rows 60A and 60B, one on each one of a pair of longer sides of the rectangular cross-section of the duct 52. Yet further, each secondary air nozzle 60 is located at a diametrically offset position from a generally opposite one of the nozzles, which is generally diametrically opposite therefrom. Thus, the rows 60A, 60B of the nozzles are misaligned or offset relative to one another such that the nozzles 60 are disposed in a staggered array. As such flows of the fresh air from the nozzles 60 may promote better mixing with the gas admitted into the intake duct 52 from the primary burn chamber 13.

In the illustrated arrangement, the secondary air that is released into the secondary burn chamber 34 by the nozzles 60 is guided to the nozzles through the housing 16 by a duct 60C extending from a rear of the housing in communication with the ambient environment thereof and through the heat exchanger container 38 to a manifold 60D in communication with all of the nozzles.

Figure 6:
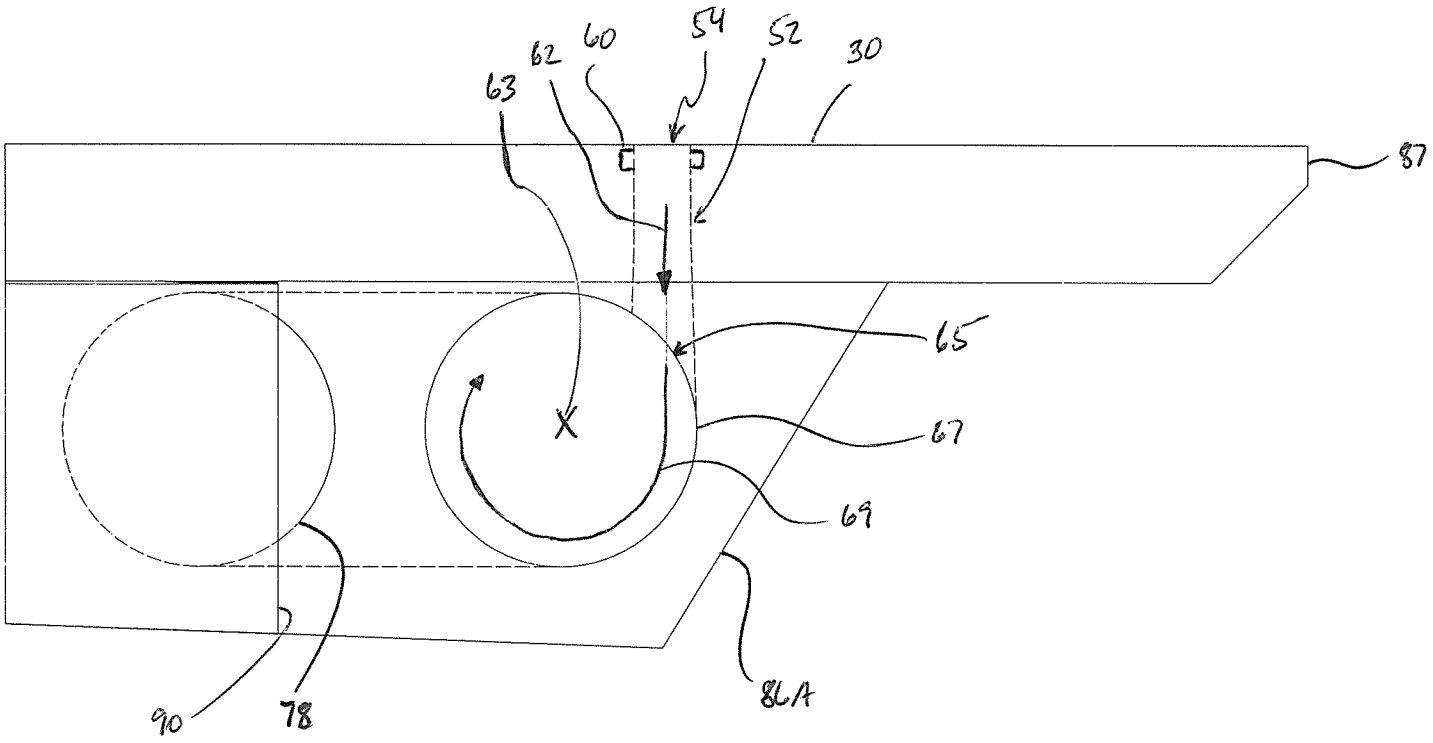
FIG. 6 is a front end view of the firebox floor of FIG. 5.
Figure 8:
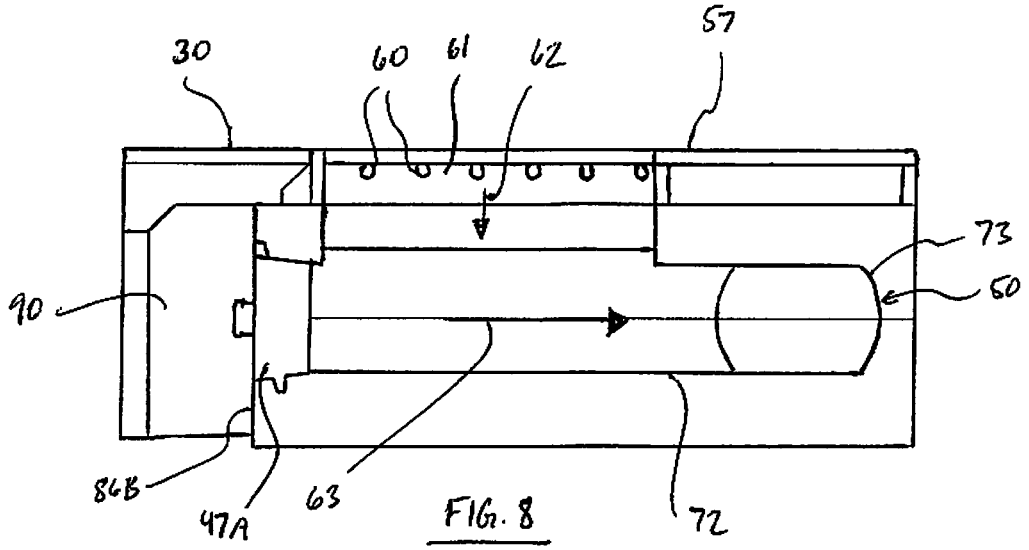
FIG. 8 is a cross-sectional view along line 8-8 in FIG. 7.
Figure 7:
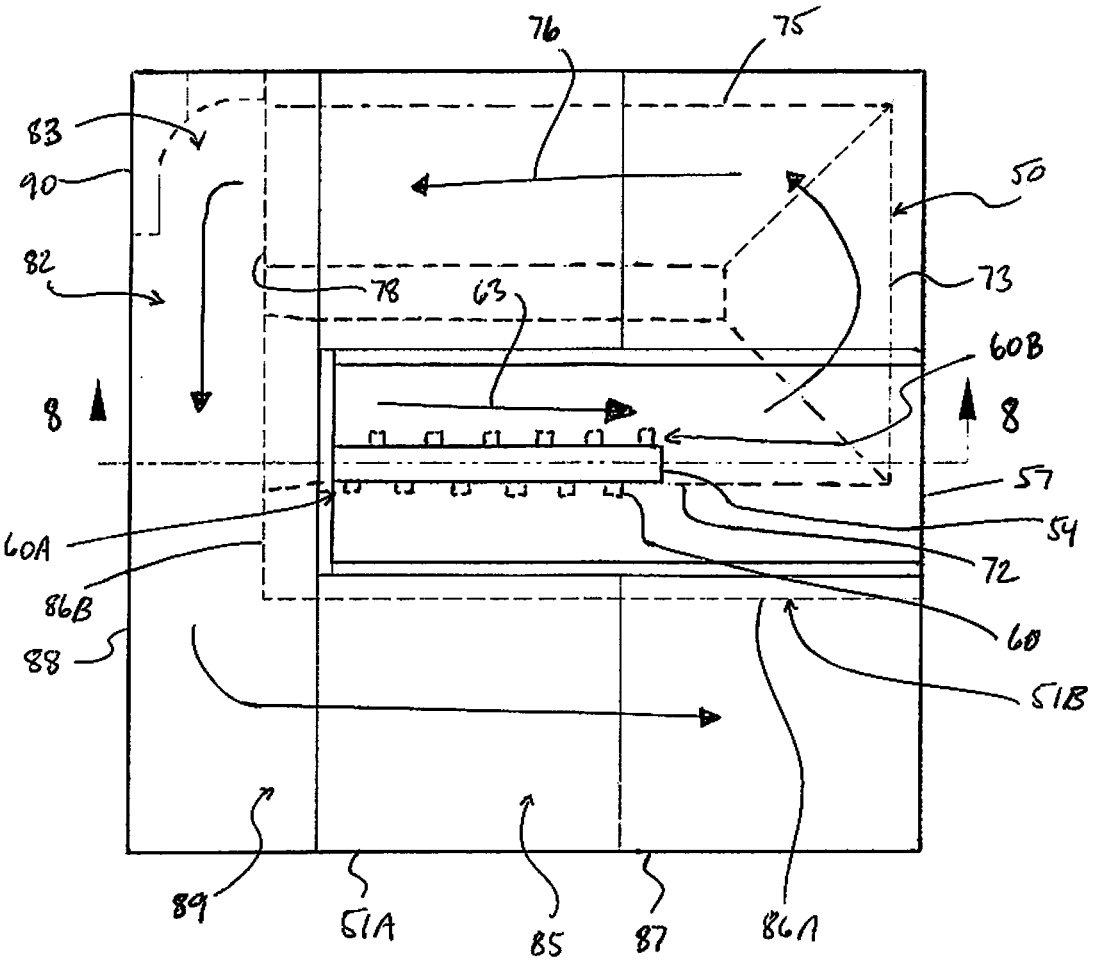
FIG. 7 is a top plan view of the firebox floor of FIG. 5.

The gas conveyed by the intake duct 52 is subsequently released to the combustion duct 50 which is arranged to convey the gas in a transverse direction to a direction of conveyance of the intake duct, as more clearly shown by FIGS. 6 and 8 where arrow 62 shows the flow of the gas along the intake duct 52 and arrow 63 shows the initial flow of the gas along the combustion duct 50. Referring to FIGS. 6 and 7, a directionality of this transition in the gas flow from the intake to the combustion duct is in part affected by opening 65 which intercommunicates the intake duct 52 and the combustion duct 50 and is arranged at a transversely centrally offset location relative to the combustion duct 50, such that transfer of the gas from the intake duct 50 to the combustion duct 52 acts to generate turbulence in the flow of the wood gas through the combustion duct. To amplify the turbulence the combustion duct 50 comprises a peripheral wall 67 arranged to convey the wood gas that is rounded, for at least an initial portion extending beneath the opening 65 that is, and the intake duct extends tangentially along a linear path to the combustion duct 50 as more clearly shown in FIG. 6. Thus the flow of gas in the combustion duct initially follows a helical path represented by arrow 69.

Referring now to FIG. 7, from an end of the intake duct 52 as defined by the opening 65 the combustion duct 50 initially extends linearly so as to have an initial upstream linear portion 72 in communication with the intake duct 52 and further comprises a turn 73 which is downstream from the intake duct 52. This first turn 73 extends from the upstream linear portion 72 in a transversely opposite direction relative to a side of the upstream linear portion 72 on which the intake duct 52 is located. Thus the direction in which the turn 73 extends from the upstream linear portion 72 acts to cooperate with the direction of spinning of the gas, indicated at 69, that is due to the spatial relationship between the intake duct 52 and the upstream linear portion of the combustion duct 50.

From the turn 73 the combustion duct 50 extends generally linearly so as to have a downstream linear portion 75 but does so in an opposite longitudinal direction to the upstream portion 72 such that a direction of the flow of gas along the downstream linear portion 75 is substantially reversed, as shown by arrow 76, relative to a direction of the flow of the wood gas along the upstream linear portion 72 shown by arrow 63. In the illustrated arrangement, the downstream linear portion 75 extends from the turn 73 in generally parallel relation to the upstream linear portion 72 such that the upstream linear portion, the turn and the downstream linear portion are collectively generally in the shape of a U.

Generally speaking, the combustion duct 50 comprises at least one turn of at least about 90 degrees, such as that at 73, that is arranged to generate turbulence in the flow of the gas through the combustion duct. There is at least one such turn along the combustion duct 50 which is between about 150 degrees and about 190 degrees. In the illustrated arrangement, there is only one such turn which is 180 degrees which satisfactorily generates turbulence to promote combustion of the combustible products in the gas flowing through the duct 50. The whole of the combustion duct lies in a substantially horizontal plane.

The combustion duct 50 terminates with the downstream linear portion 75 which opens at 78 to an ash deposition duct 79 of the secondary burn chamber 34. That is, the ash deposition duct 79 is in downstream communication with the combustion duct 50 and is arranged to receive therefrom the combustion exhaust gas substantially free of the incompletely combusted products of combustion and to permit ash carried by the gas to separate from the gas flow. As such the ash deposition duct 79 is formed within the housing 16 but externally of the body of refractory material 47 and in general has a larger cross-section over a majority of its length than the combustion duct 50 so that the flow of the combustion exhaust gas has reduced velocity conducive to permitting ash carried thereby to gravitationally separate from the flow of the gas.

As previously mentioned the ash deposition duct 79 is formed outside the body of thermally conductive material 47 but a peripheral wall of the duct 79 which is arranged to convey the exhaust gas is collectively formed by the body of refractory material 47 and the housing 16. Thus the ash deposition duct 79 is heated by the heat carried by the thermally conductive refractory body 47 which may act to combust any incompletely combusted products still within the ash deposition duct, thereby generating hot products of combustion. However, as the ash deposition duct 79, where ash is intended to collect once separated from the gas flow, is located outside the refractory body 47 the separated ash is easier to remove from the housing 16 when cleaning. To this effect the housing 16 includes an opening 80 in the front wall 18 that is arranged for passing cleaning tools through for removing the ash from the secondary burn chamber. The opening 80 is closed by door 81 hingedly carried on the front wall 18. It will be appreciated that the body of refractory material 47 includes a removable plug 47A which closes an opening that otherwise communicates the upstream portion 72 of the combustion duct with the ash deposition duct, and through which cleaning utensils can be passed for cleaning the combustion duct.

Referring to FIG. 7, to promote separation of ash from the gas flow the ash deposition duct 79 has a linearly extending upstream portion 82 which is in communication with the combustion duct 50 to receive the combustion exhaust gas therefrom and which meets the combustion duct 50 to form a turn of at least 90 degrees indicated at 83. The ash deposition duct also comprises a linearly extending downstream portion 85 in communication with the heat exchanger 36 to release the exhaust gas thereto and having larger cross-section than the upstream portion 82. The larger cross-section of the downstream portion 85 is provided in part by a side wall 86A of the burn chamber portion of the firebox floor 12, which delimits the downstream portion 85 and is spaced further inwardly from parallel edge 87 at the side of the floor portion 51A than end wall 86B from parallel edge 88 at the front of the floor portion 51A, which delimits the upstream portion 82. Moreover, the side wall 86A is inclined downwardly and inwardly to augment the cross-sectional size of the downstream ash deposition duct portion 85.

Also, the upstream and downstream portions 82, 85 of the ash deposition duct 79 meet at a turn 89 of at least about 90 degrees, such that the ash deposition duct 79 comprises a plurality of turns at spaced positions relative to the flow of the exhaust gas through the duct, with each of the turns being of at least about 90 degrees so as to be arranged to separate the ash from the flow of exhaust gas by inertia.

An outer side of the turn 83 between the combustion duct 50 and the ash deposition duct 79 is defined by a generally L-shaped wall 90 of thermally conductive refractory material connected to the body of refractory material 47 forming the firebox floor 12 so as to receive heat therefrom. Thus the gas transitioning from the combustion duct 50 to the ash deposition duct 79 is subjected to turbulent impact with the wall 90 which may act to apply additional heat to the gas prior to continued flow through the ash deposition duct 79. The wall 90 depends downwardly from the floor portion 51A of the refractory body 47, which is enlarged in plan size relative to the burn chamber portion 51B so as to span the interior of the primary burn chamber 13 in a manner separating the primary burn chamber 13 from the secondary burn chamber 34. The wall 90 also extends along a periphery of the floor portion 51A and meets the inwardly spaced end wall 86B of the burn chamber portion 51B. Thus the L-shaped wall 90 acts to line the ash deposition duct such that at the turn 83 the ash deposition duct is surrounded substantially by the body of refractory material 47 but remains formed externally thereof as a bottom of the duct 79 at the turn 83 is defined by the housing 16.

It will be appreciated that the ash deposition duct 79 formed externally of the body of refractory material 47 is longer in length than the combustion duct 50 formed internally of the body of refractory material 47, particularly when paths of the two ducts 50, 79 collectively span the whole of a surface area of the firebox floor 12 as defined by the floor portion 51A. The U-shaped combustion duct 50 provides sufficient distance over which to combust combustible products carried in the gas generated in the primary burn chamber 13, especially since the combustion duct 50 conveying this gas is heated by the same heat generated in the primary burn chamber 13. The L-shaped ash deposition duct 79 then provides sufficient distance over which the ash generated during combustion in the combustion duct 50 can separate out from the gas flow. Thus the gas released from the secondary burn chamber 34 to the heat exchanger 36 is substantially free of incompletely combusted products and ash resulting from the combustion thereof.

In order to optimize performance of the secondary burn chamber 34, which includes maximizing lengths of the two ducts 50, 79 primarily forming the secondary burn chamber 34, the inlet 54 of the secondary burn chamber 34 which in the illustrated arrangement is located in the upper support surface 30 is centrally located therein so as to substantially uniformly draw the gas from the whole of the primary burn chamber 13.

Furthermore, an outlet of the secondary burn chamber 34 that is defined by the opening 43 intercommunicating the same and the heat exchanger 36 through the partition wall 24 is located at a horizontally centrally offset location therein so as to be located closer to one side than to the other side. The outlet 43 is located below the floor defined by the surface 30 such that substantially a whole of the secondary burn chamber 34 is below the primary burn chamber 13.

As such, in order to maximize a length of a path for the flow of gas from the inlet 54 of the secondary burn chamber 34 to the outlet 43 thereof, the path of the secondary burn chamber 34 comprises an initial portion defining the inlet 54 and the combustion duct 50 and extending from a central location beneath the floor defined by the floor portion 51A and towards a location on the partition wall 24 which is horizontally to the side of the outlet 43, as more clearly illustrated in FIG. 7 and represented by the upstream portion 72 of the combustion duct. This path further includes a downstream turn 73, that is downstream in relation to the initial portion relative to the flow of gas through the secondary burn chamber 34, extending from the initial portion 72 in a direction away from the outlet 43. That is, the turn 73 extends from the initial upstream portion 72 to an opposite side of the furnace relative to that on which the outlet 43 is located.

In order for the path of the secondary burn chamber to reach the outlet 43 after the turn 73 the secondary burn chamber comprises multiple subsequent turns such that the chamber 34 comprises a plurality of turns, which are arranged to generate turbulence in the flow of gas therealong, and which promotes combustion in the combustion duct 50 and separation of ash in the ash separation duct 79. A sum of angles of all of the turns of the secondary burn chamber path, beneath the upper support surface 30, from the combustion duct 50 to the outlet 43, is from about 270 degrees to about 360 degrees.

In use of the furnace 10, once the solid biomass fuel in the form of wood has been located in the primary burn chamber 13, heat is applied in the primary burn chamber so that gas is generated from the wood fuel. In the illustrated arrangement this is achieved by providing a heat source in the form of combusted or ignited coal to generate heat for subsequent application to the wood fuel, which acts to gasify or vaporize the same to generate wood gas which is simply wood in gaseous form.

The generated gas is drawn through a centrally-located opening 54 in the floor of the primary burn chamber 13 and guided through a duct 50 formed in the same body of material defining the floor of the primary burn chamber 13. This material, which is a thermally conductive refractory material, thus provides a heated secondary burn chamber through which the wood gas travels a predetermined path having turns to generate turbulence. The secondary burn chamber 34 is heated by the same source of heat which generates the gas in the primary burn chamber 13. Thus a temperature within the secondary burn chamber 34 is in a suitable threshold range to effect combustion of the wood gas such that before release to the heat exchanger 36 at the outlet 43, and preferably by the end of the combustion duct 50 at opening 78 which is at an upstream location from the outlet 43, all combustible products in the gas have been combusted. This leaves a distance over which the exhaust gas can flow within the secondary burn chamber 34 in a manner releasing therefrom the ash generated by combustion for subsequent collection in the chamber 34.

The substantially clean gas released to the heat exchanger 36, which is substantially free of incompletely combusted products and of ash, is passed through the heat exchanger to transfer heat to the heat transfer or transport medium and is subsequently released to the ambient environment via flue 42.

This provides an arrangement for generating heat from wood which produces substantially no incompletely combusted emission products for discharge to the atmosphere.

As described hereinbefore the present invention in one aspect relates to a furnace for combusting wood comprises a firebox floor in a primary burn chamber of the furnace, where the wood is received for generating a gas therefrom, that is defined by a thermally conductive body of refractory material. The body of refractory material defines an upper support surface arranged to support the wood above or over the same. The body of refractory material also defines, beneath the upper support surface, a duct as part of a secondary burn chamber of the furnace which is arranged (i) to be communicated with the primary burn chamber of the furnace to receive the gas generated by heating of the wood therein and carrying combustible products, and (ii) to convey the gas in a manner supporting combustion of the combustible products carried thereby.

The scope of the claims should not be limited by the preferred embodiments set forth in the examples but should be given the broadest interpretation consistent with the specification as a whole.

The invention claimed is:

1. A furnace for combusting wood comprising:

a base arranged for resting on a support surface;

a housing supported on the base and defining a primary burn chamber arranged for containing the wood to generate a combustible gas therefrom;

a body of refractory material carried at a bottom of the primary burn chamber and defining an upper support surface arranged for supporting the wood thereabove that defines a floor of the primary burn chamber;

a secondary burn chamber in communication with the primary burn chamber for receiving the combustible gas generated in the primary burn chamber and arranged for combusting the combustible gas to generate exhaust gas which is substantially free of incompletely combusted products of combustion;

a heat exchanger supported in the housing outside the primary and secondary burn chambers and in communication with the secondary burn chamber to receive the exhaust gas therefrom, the heat exchanger being configured for transferring heat from the exhaust gas to a heating medium which acts to subsequently distribute the heat;

a flue in communication with the heat exchanger and arranged for releasing the exhaust gas with the heat removed therefrom to an ambient environment of the furnace; and a fan operatively carried by the housing at a downstream location from the secondary burn chamber and arranged to generate an airflow to draw gas from the primary burn chamber and to the flue so as to define a flow of gas through the furnace;

wherein the body of refractory material is thermally conductive; and wherein the secondary burn chamber comprises a combustion duct which is defined in the body of thermally conductive refractory material below the upper support surface and arranged to convey the combustible gas and to support combustion thereof upon conveyance through the combustion duct before release to the heat exchanger.

2. The furnace of claim 1 wherein the secondary burn chamber comprises:

an intake duct intercommunicating the primary burn chamber and the combustion duct downstream therefrom relative to the flow of the gas through the furnace; and a plurality of nozzles in fluidic communication with the intake duct and arranged for injecting fresh air into the secondary burn chamber for mixing with the combustible gas for subsequent combustion in the combustion duct.

3. The furnace of claim 2 wherein the nozzles are arranged at spaced positions around a peripheral wall of the intake duct such that the fresh air is introduced into the intake duct substantially around a full periphery of the intake duct.

4. The furnace of claim 3 wherein each nozzle is located at a diametrically offset position from a generally opposite one of the nozzles such that a flow of the fresh air from each nozzle promotes mixing with the combustible gas.

5. The furnace of claim 2 wherein the intake duct defines an inlet of the secondary burn chamber in the floor such that the intake duct extends through the floor to the combustion duct in the body of the refractory material.

6. The furnace of claim 5 wherein the intake duct is defined by a metallic grate member supported by the body of refractory material above the combustion duct and defining an upper surface collectively forming with said body of refractory material the floor of the primary burn chamber.

7. The furnace of claim 1 wherein, when the secondary burn chamber comprises an intake duct intercommunicating the primary burn chamber and the combustion duct downstream therefrom relative to the flow of the gas through the furnace, the combustion duct is arranged to convey the combustible gas in a transverse direction to a direction of conveyance of the intake duct, and an opening intercommunicating the intake duct and the combustion duct is arranged at a transversely centrally offset location relative to the combustion duct such that transfer of the combustible gas from the intake duct to the combustion duct acts to generate turbulence in the flow of the combustible gas through the combustion duct.

8. The furnace of claim 7 wherein the combustion duct comprises a rounded peripheral wall arranged to convey the combustible gas and the intake duct extends tangentially to the combustion duct.

9. The furnace of claim 7 wherein the combustion duct comprises an upstream linear portion extending linearly from the intake duct and a turn downstream from the intake duct which extends from the upstream linear portion in a transversely opposite direction relative to a side of the upstream linear portion on which the intake duct is located.

10. The furnace of claim 9 wherein the combustion duct further comprises a downstream linear portion extending from the turn in an opposite longitudinal direction to the upstream linear portion such that a direction of the flow of the combustible gas along the downstream linear portion is substantially reversed relative to a direction of the flow of the combustible gas along the upstream linear portion.

11. The furnace of claim 1 wherein the combustion duct comprises at least one turn of at least about 90 degrees arranged to generate turbulence in the flow of the gas through the combustion duct.

12. The furnace of claim 11 wherein said at least one turn comprises a first turn between about 150 degrees and about 190 degrees.

13. The furnace of claim 12 wherein the first turn is about 180 degrees.

14. The furnace of claim 13 wherein the first turn is the only turn of the combustion duct.

15. The furnace of claim 1 wherein the secondary burn chamber comprises a plurality of turns arranged to generate turbulence in the flow of gas therealong, and a sum of angles of all of the turns is from about 270 degrees to about 360 degrees.

16. The furnace of claim 1 wherein the secondary burn chamber further comprises:

an ash deposition duct in downstream communication with the combustion duct and arranged to receive therefrom the exhaust gas substantially free of the incompletely combusted products of combustion;

wherein the ash deposition duct is formed within the housing but externally of the body of refractory material; and wherein the ash deposition duct has a larger cross-section than the combustion duct so that the flow of the exhaust gas has reduced velocity conducive to permitting ash carried by the exhaust gas to gravitationally separate therefrom.

17. The furnace of claim 16 wherein the ash deposition duct comprises at least one turn of at least about 90 degrees arranged to separate the ash from the flow of exhaust gas by inertia.

18. The furnace of claim 16 wherein the ash deposition duct comprises a peripheral wall arranged to convey the exhaust gas that is collectively formed by the body of refractory material and the housing.

19. The furnace of claim 16 wherein the combustion duct and the ash deposition duct meet to form a turn of at least about 90 degrees.

20. The furnace of claim 19 wherein an outer side of said turn between the combustion duct and the ash deposition duct is defined by a wall of thermally conductive refractory material connected to the body of refractory material so as to receive heat therefrom.

21. The furnace of claim 16 wherein the ash deposition duct comprises a plurality of turns at spaced positions relative to the flow of the exhaust gas through the ash deposition duct, each of the turns being of at least about 90 degrees.

22. The furnace of claim 16 wherein the ash deposition duct formed externally of the body of refractory material is longer in length than the combustion duct formed internally of the body of refractory material.

23. The furnace of claim 16 wherein the ash deposition duct has an upstream portion which is in communication with the combustion duct to receive the exhaust gas therefrom and a downstream portion in communication with the heat exchanger to release the exhaust gas thereto, and the downstream portion of the ash deposition duct has larger cross-section than the upstream portion thereof.

24. The furnace of claim 23 wherein the upstream and downstream portions of the ash deposition duct meet at a turn of at least about 90 degrees.

25. The furnace of claim 1 wherein the secondary burn chamber comprises an inlet defined in the floor and in communication with the primary burn chamber to enable passage of the combustible gas therefrom and to the combustion duct.

26. The furnace of claim 25 wherein the inlet is substantially centrally located on the floor.

27. The furnace of claim 26 wherein:

the housing comprises a common generally vertically-oriented partition wall spanning from a bottom of the housing to a top thereof and separating the primary and secondary burn chambers from the heat exchanger;

the secondary burn chamber comprises an outlet arranged in communication with the heat exchanger through the partition wall;

the outlet is located at a horizontally centrally offset location;

the secondary burn chamber defines a path for the flow of gas from the inlet to the outlet; and the path of the secondary burn chamber comprises:

an initial portion defining the inlet and the combustion duct and extending from a central location beneath the floor towards a location on the partition wall which is horizontally to the side of the outlet, and a downstream turn extending from the initial portion in a direction away from the outlet.

28. The furnace of claim 25 wherein the secondary burn chamber comprises an outlet arranged in communication with the heat exchanger and defined below the floor such that substantially a whole of the secondary burn chamber is below the primary burn chamber.

* * * * *